US009151001B2

(12) United States Patent
Combs

(10) Patent No.: US 9,151,001 B2
(45) Date of Patent: Oct. 6, 2015

(54) RAILROAD RAIL AND TIE FASTENER APPARATUSES AND METHODS THEREOF

(71) Applicant: Mark E. Combs, Morrisville, NY (US)

(72) Inventor: Mark E. Combs, Morrisville, NY (US)

( * ) Notice: Subject to any disclaimer, the term of this patent is extended or adjusted under 35 U.S.C. 154(b) by 189 days.

(21) Appl. No.: 13/841,958

(22) Filed: Mar. 15, 2013

(65) Prior Publication Data

US 2013/0334331 A1 Dec. 19, 2013

Related U.S. Application Data

(60) Provisional application No. 61/661,560, filed on Jun. 19, 2012.

(51) Int. Cl.
*E01B 9/00* (2006.01)
*E01B 9/64* (2006.01)

(52) U.S. Cl.
CPC ..... *E01B 9/64* (2013.01)

(58) Field of Classification Search
CPC ..... B66B 7/02; B66B 7/024; E01B 9/64; E01B 9/66; E01B 9/00; E01B 5/16; Y10T 29/49947; Y10T 29/49826
See application file for complete search history.

(56) References Cited

U.S. PATENT DOCUMENTS

| | | | | |
|---|---|---|---|---|
| 1,014,087 | A * | 1/1912 | Moffett | 238/288 |
| 1,014,088 | A * | 1/1912 | Moffett | 238/288 |
| 1,655,305 | A | 1/1928 | Barnes | |
| 2,397,750 | A * | 4/1946 | Preston | 238/314 |
| 2,911,154 | A * | 11/1959 | Cushman | 238/314 |
| 4,108,378 | A | 8/1978 | Raymond | |
| 4,260,105 | A | 4/1981 | Phillips | |
| 4,382,574 | A | 5/1983 | Ellestad | |
| 5,135,165 | A * | 8/1992 | Greenhow | 238/341 |
| 5,449,116 | A * | 9/1995 | Bruning | 238/295 |
| 6,305,615 | B1 * | 10/2001 | Traktovenko | 238/315 |
| 2013/0334331 | A1 * | 12/2013 | Combs | 238/314 |
| 2014/0203096 | A1 * | 7/2014 | Combs | 238/314 |

FOREIGN PATENT DOCUMENTS

| | | | |
|---|---|---|---|
| RU | 1794965 | A1 | 2/1993 |
| RU | 2380470 | C2 | 1/2010 |
| SU | 105327 | A1 | 11/1956 |
| SU | 419596 | A1 | 3/1974 |

OTHER PUBLICATIONS

International Search Report for International Patent Application No. PCT/US2013/046376 (Sep. 19, 2013).

* cited by examiner

*Primary Examiner* — Jason C Smith
(74) *Attorney, Agent, or Firm* — LeClairRyan, a Professional Corporation

(57) ABSTRACT

An exemplary fastener apparatus for a railroad rail and tie includes a yoke plate, at least one securing tooth, and opposing securing arms. The yoke plate has a first plate extending along a first plane and a second plate extending out from an edge of the first plate and along a second plane which is at a different angle from the first plane. The securing tooth extends out from the second plate in a first direction. The opposing securing arms are spaced apart from each other a distance to detachably seat over the railroad tie and extend out from the first plate in the first direction.

28 Claims, 4 Drawing Sheets

RAILROAD RAIL AND TIE FASTENER APPARATUSES AND METHODS THEREOF

This application claims the benefit of U.S. Provisional Patent Application Ser. No. 61/661,560, filed Jun. 19, 2012, which is hereby incorporated by reference in its entirety.

FIELD

This invention generally relates devices and methods relating to railroad tracks and, more particularly, to railroad rail and tie fastener apparatuses and methods thereof.

BACKGROUND

Conventional railroad construction relies on spikes to hold rails and tieplates down onto the ties. Unfortunately, over time spike holes enlarge and spikes work up and out of the ties, reducing holding strength and rail stability. As a result, with conventional railroad construction the existing railroad spikes and tieplates require more maintenance, allowable loads and speeds are lower than desired, and the possibility of a derailment increases over time.

SUMMARY

An exemplary fastener apparatus for a railroad rail and tie includes a yoke plate, at least one securing tooth, and opposing securing arms. The yoke plate has a first plate extending along a first plane and a second plate extending out from an edge of the first plate and along a second plane which is at a different angle from the first plane. The securing tooth extends out from the second plate in a first direction. The opposing securing arms are spaced apart from each other a distance to detachably seat over the railroad tie and extend out from the first plate in the first direction.

A method for making a fastener apparatus for a railroad rail and tie includes providing a yoke plate with a first plate that extends along a first plane and a second plate that extends out from an edge of the first plate and along a second plane which is at a different angle from the first plane. At least one securing tooth is provided that extends out from the second plate in a first direction. Opposing securing arms are provided that are spaced apart from each other a distance to detachably seat over the railroad tie and extend out from the first plate in the first direction.

This technology provides a number of advantages including providing more secure and longer lasting railroad rail and tie fastener apparatuses and methods. Additionally, this technology provides a stronger holding force and more accurate and precise retention of the railroad rails to the ties which are especially important for high-speed rail or heavy rail load use. Further, with this technology less regular maintenance is required and much greater rail safety is provided. This technology also allows for preassembling of entire track sections which then can be transported to the installation site providing further reductions in rail construction costs and faster railroad construction.

DETAILED DESCRIPTION

Figure 1:
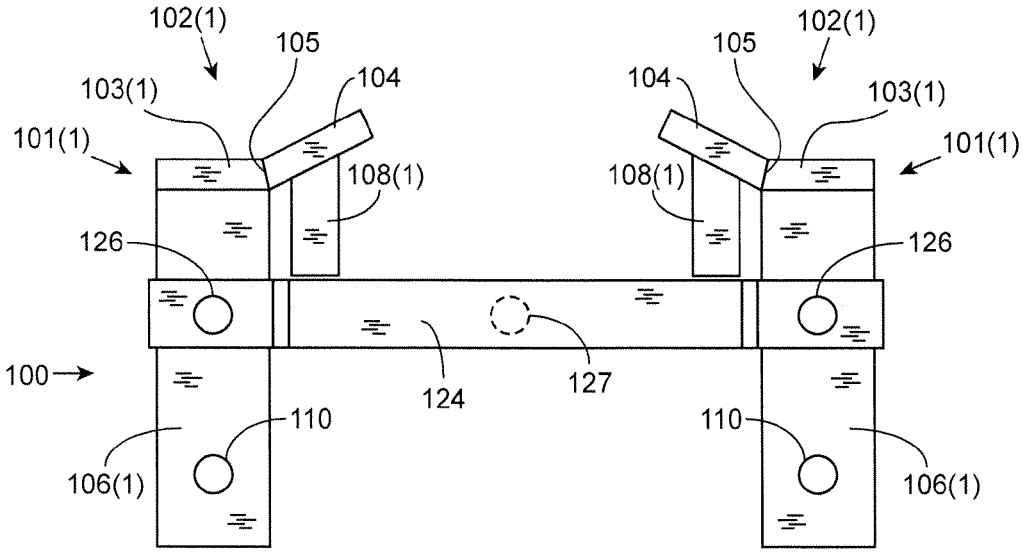
FIG. 1 is a side elevation view of an exemplary railroad rail and tie fastener apparatus.
Figure 2:
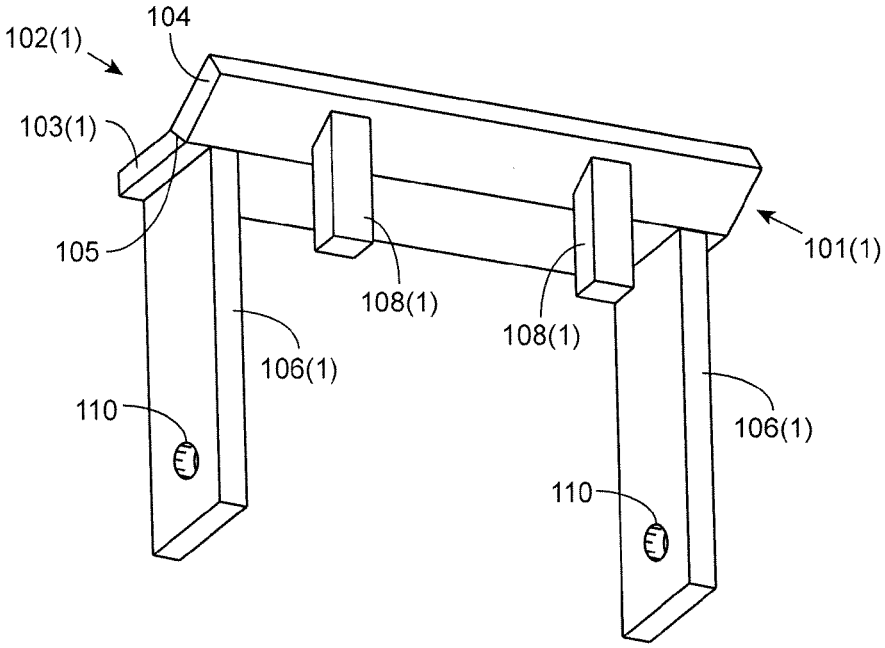
FIG. 2 is a perspective side view of an exemplary railroad rail and tie hold-down yoke.
Figure 3:
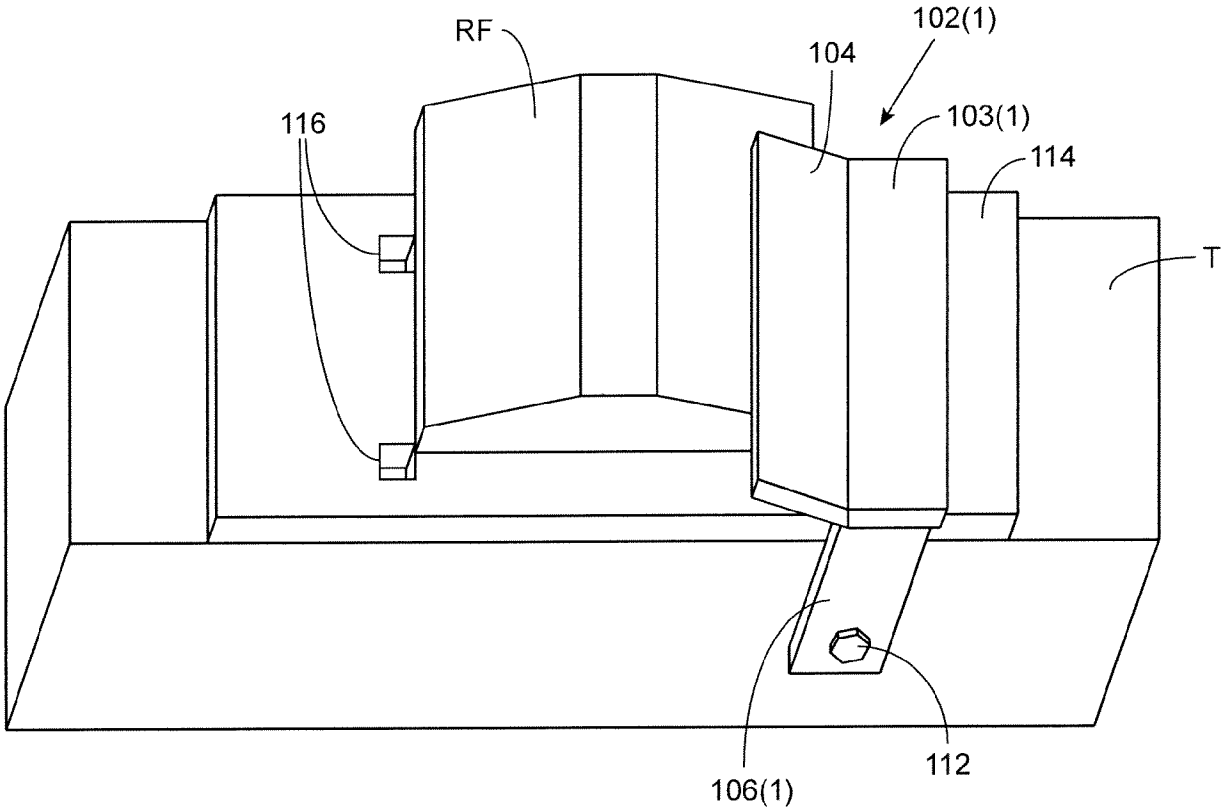
FIG. 3 is a perspective and partially cut-away top view of the railroad rail and tie hold-down yoke securing a flange of a rail and tieplate to a rail tie.

An exemplary railroad rail and tie fastener apparatus 100 is illustrated in FIGS. 1-3. The exemplary railroad rail and tie fastener apparatus 100 includes railroad rail and tie hold-down yokes 101(1), stabilizing bar 124, and tie plate 114, although the apparatus can include other types and numbers of systems, devices, components, or other elements in other configurations. This technology provides a number of advantages including providing more secure and longer lasting railroad rail and tie fastener apparatuses and methods.

Referring more specifically to FIGS. 1-3, each of the railroad rail and tie hold-down yokes 101(1) includes a yoke plate 102(1), securing arms 106(1), and teeth 108(1), although the railroad rail and tie hold-down yokes can include other types and numbers of systems, devices, components, or other elements in other configurations. Each of the yoke plates 102(1) has a first plate 103(1) which extends along a first plane and a second plate 104 that extends out from an edge 105 of the first plate 102(1) and along a second plane which is at a different angle from the first plane, although the first plate 103(1) and the second plate 104 can be connected together in other manners and configurations and the yoke plate can have other numbers and types of plates. In this example, when each of the railroad rail and tie hold-down yokes 101(1) are installed over a railroad tie T and secured against a rail flange RF, each of the plates 103(1) and 104 lie crosswise over the railroad tie T, the first plates 103(1) are seated on and in full contact with a surface of the tieplate 114, and the second plates 104 are each at an angle beveled upwards to hold down one side of the rail flange RF.

Figure 7:
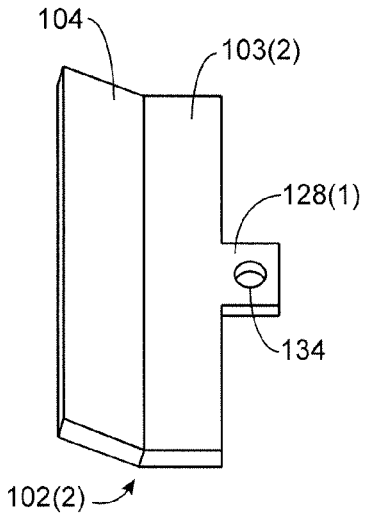
FIG. 7 is a perspective top view of another yoke plate with a yoke tab.
Figure 8:
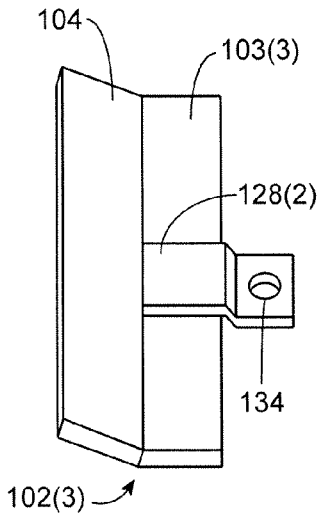
FIG. 8 is a perspective top view of another yoke plate with another yoke tab.
Figure 9:
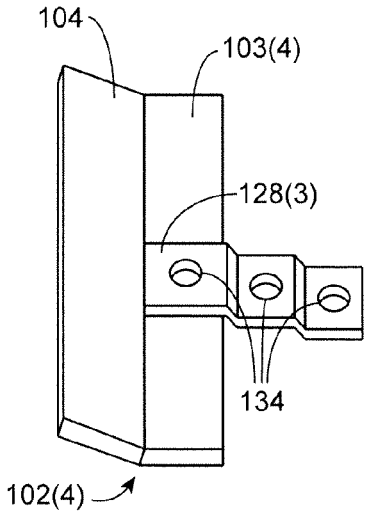
FIG. 9 is a perspective top view of another yoke plate with yet another yoke tab.

Referring to FIGS. 7-9, other types of yoke plates 102(2)-102(4) by way of example only are illustrated, although other types of yoke plates could be used. Each of the yoke plates 102(2)-102(4) is the same in structure and operation as yoke plate 102(1), except as illustrated and described herein. Elements in yoke plates 102(2)-102(4) which are like those in yoke plate 102(1) will have like reference numerals and will not be described again.

Referring to FIG. 7, the yoke plate 102(2) has an optional yoke tab 128(1) extending out from an opposing edge of the first plate 103(2) and along the first plane, although the yoke tab 128(1) could be connected to the first plate 103(2) at other locations and extend out in other planes and directions. In this example, the yoke tab 128(1) is integrally formed with the first plate 103(2), although the yoke tab 128(1) could be a separate element which is connected to the first plate 128(2), such as by a weld. The yoke tab 128(1) includes an aperture 134 which is sized to receive a bolt or other detachable securing device to detachably secure the yoke tab 128(1) to the tieplate 114 for additional strength and stability, although other manners for securing the yoke plate 102(2) to the tieplate 114 can be used. In this and other examples illustrated and described herein, each of the bolts and other securing mechanisms could be welded to add a further level of strength and also security from any vandalism.

Referring to FIG. 8, the yoke plate 102(3) has an optional yoke tab 128(2) extending out from an opposing edge of the first plate 103(3), although the yoke tab 128(2) could be connected to the first plate 103(3) at other locations. In this example, yoke tab 128(2) has a first portion configured to be seated on a surface of the first plate 103(3) and a second portion that extends out substantially along a third plane which is substantially parallel to the first plane, although the yoke tab 128(2) could have other numbers and types of portions that extend out in other planes and directions. The first portion of the yoke tab 128(2) is welded to the surface of the first plate 103(3) and extends along a plane parallel to the first plane. The second portion of the yoke tab 128(2) includes an aperture 134 which is sized to receive a bolt or other detachable securing device to detachably secure the yoke tab 128(2) to the tieplate 114 for additional strength and stability, although other manners for securing the yoke plate 102(3) to the tieplate 114 can be used.

Referring to FIG. 9, the yoke plate 102(4) has an optional yoke tab 128(3) extending out from an opposing edge of the first plate 103(4), although the yoke tab 128(3) could be connected to the first plate 103(4) at other locations. In this example, yoke tab 128(3) has a first portion configured to be seated on a surface of the first plate 103(4), a second portion that extends out substantially along a third plane which is substantially parallel to the first plane, and a third portion that extends out substantially along a fourth plane which is substantially parallel to the first plane and third plane, although the yoke tab 128(3) could have other numbers and types of portions that extend out in other planes and directions. The first portion of the yoke tab 128(3) includes an aperture 134 which is sized to receive a bolt or other detachable securing device to detachably secure the yoke tab 128(2) to and/or through the first plate 103(4) and extends along a plane parallel to the first plane. The second portion of the yoke tab 128(3) includes another aperture 134 which is sized to receive another bolt or other detachable securing device to detachably secure the yoke tab 128(2) to the tieplate 114 for additional strength and stability, although other manners for securing the yoke plate 102(4) to the tieplate 114 can be used. The third portion of the yoke tab 128(3) includes another aperture 134 which is sized to receive another bolt or other detachable securing device to detachably secure the yoke tab 128(2) to the rail tie T for further strength and stability, although other manners for securing the yoke plate 102(4) to the tieplate 114 and/or the rail tie T can be used.

Referring back to FIGS. 1-3, two teeth 108(1) descend vertically from the angled plate 104, although other types and numbers of teeth or other securing elements could be used, such as one or three or more teeth. The teeth 108(1) have an outer periphery which is configured or shaped to mate or otherwise fit through the apertures 116 in the tieplate 114 and into the rail tie T to locate and secure the rail flange RF to the tieplate 114 and the rail tie T on which the tieplate 114 rests.

Figure 4:
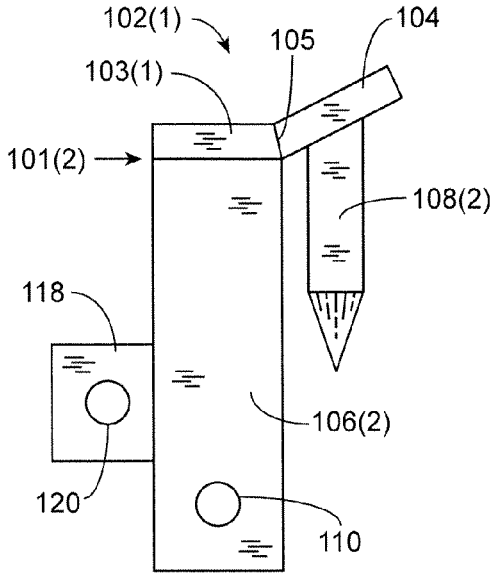
FIG. 4 is a side elevation view of another example of a rail tieplate hold-down yoke.

Referring to FIG. 4, another example of a tooth 102(2) which can be used with a railroad rail and tie hold-down yoke 101(2) is illustrated. The railroad rail and tie hold-down yoke 101(2) is the same in structure and operation as the railroad rail and tie hold-down yokes 101(1), except as illustrated and described herein. Elements in railroad rail and tie hold-down yoke 101(2) which are like those in railroad rail and tie hold-down yoke 101(1) will have like reference numerals and will not be described again. In this particular example, the tooth 102(2) is formed with an elongated, chisel-tipped tooth profile to allow the tooth 108(2) to assist in passing through aperture 116 and to be more easily forcibly impressed into the tie T, although the tooth can have other configurations. The railroad rail and tie hold-down yokes 101(2) also has different securing arms 106(2) as described later herein.

Figure 5:
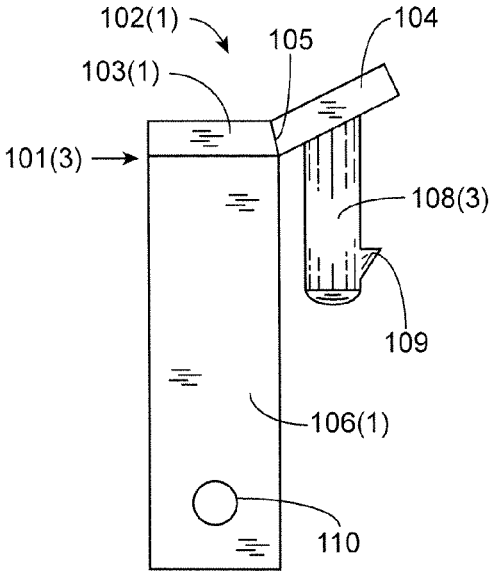
FIG. 5 is a side elevation view of yet another example of a rail tieplate hold-down yoke

Referring to FIG. 5, another example of a tooth 102(3) which can be used with a railroad rail and tie hold-down yoke 101(3) is illustrated. The railroad rail and tie hold-down yoke 101(3) is the same in structure and operation as the railroad rail and tie hold-down yoke 101(1), except as illustrated and described herein. Elements in railroad rail and tie hold-down yokes 101(3) which are like those in railroad rail and tie hold-down yokes 101(1) will have like reference numerals and will not be described again. In this particular example, the tooth 108(3) has a substantially cylindrical shape to assist in passing through the aperture 116 and to be more easily forcibly impressed into the tie T, although the tooth can have other configurations. Additionally, in this example the tooth 108(3) has a barb 109 to assist in retaining the tooth 108(3) in the rail tie T, although the tooth could have other types and numbers of barbs or other securing elements.

Referring back to FIGS. 1-3, the two securing arms 106(1) are spaced apart from each other a distance to detachably seat over the railroad tie T, although each of the railroad rail and tie hold-down yokes 101(1) could have other types and numbers of securing arms, such as two pairs of securing arms by way of example only. In this example, the two securing arms 106(1) extend out from the first plate 103(1) in the first direction and are positioned to be secured against the sides of the rail tie T, using bolts secured through two holes 110, although numbers of holes and bolts as well as other manners for connecting the securing arms 106(1) to the rail ties T can be used.

Referring to FIG. 4, in this example of the railroad rail and tie hold-down yoke 101(3) the securing arm 106(2) includes an optional arm tab 118 which extends out from a side of the securing arm 106(2), although the tab could be in other locations and have other configurations. The arm tab 118 includes a hole 120 to received an additional bolt to connect the securing arm 106(2) to the rail tie T in another location to provide additional strength and stability.

Figure 6:
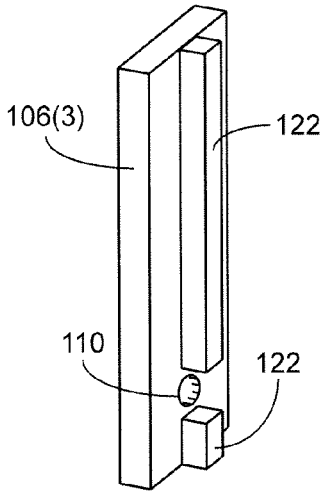
FIG. 6 is a perspective side view of an inside face of an exemplary securing arm with an optional stabilizing guide bar.

Referring to FIG. 6, in this example the securing arm 106(3) includes illustrates a guide bar 122 added to the inside face of the securing arm 106(3). The guide bar 122 has a relief clearance as part of the hole 110 to allow the insertion of a fastening bolt from the exterior face of the securing arm 106(3). The guide bar 122 has a shape which is designed to mate with a matching slot in the rail tie T to provide additional locating force and stability for the securing arm 106(3).

Figure 10:
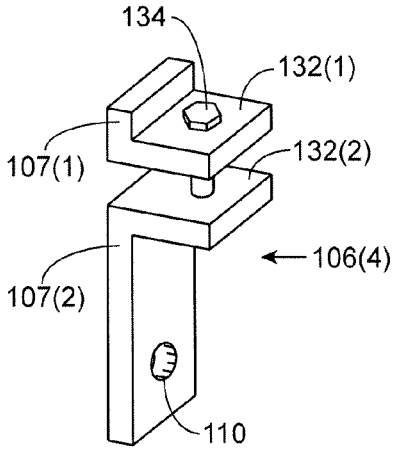
FIG. 10 is a perspective side view of another securing arm.

Referring to FIG. 10, in this example the securing arm 106(4) has been split into two sections 107(1) and 107(2) which each have a securing tab 132(1) and 132(2), respectively, although the securing arm could comprise other numbers and shapes of sections. In this example, each of the securing tabs 132(1) and 132(2) have apertures through which a bolt 134 can pass through and be fastened with a nut to secure the sections 107(1) and 107(2) together. This example allows for the railroad rail and tie hold-down yokes to be secured to the rail ties T in stages which can help to facilitate construction. After the installation of the bolt 134 and its tightened nut, the nut can be welded to the bolt 134 to forestall loosening or vandalism.

Referring back to FIG. 1, once the railroad rail and tie hold-down yokes 101(1) are seated over and secured to the rail tie T and the rail flange RF, an optional stabilizing safety bar 124 can be connected at each end to one of the railroad rail and tie hold-down yokes 101(1), although other types and numbers of stabilizing bars could be used. The optional stabilizing safety bar 124 assists in preventing lateral spreading apart of the railroad rail and tie hold-down yokes 101(1). An optional auxiliary hole 1267 could be added at the center of safety bar 124 for a securing bolt directly into the side of the rail tie.

An example of the assembly and operation of the railroad rail and tie fastener apparatus 100 on a railroad rail and tie will now be described with reference to FIGS. 1-3. In this example, each of the railroad rail and tie hold-down yokes 101(1) is seated over the rail tie T in the direction as illustrated in FIGS. 1 and 3. Each of the first plates 103(1) of the yoke plate 102(1) is held down against the surface of the tieplate 114 and each of the angled plates 104 of the yoke plate 102 is held down against one side of the rail flange RF. The yoke top-plate teeth 108(1) are passed through the apertures 116 and into the tie T to locate each of the railroad rail and tie hold-down yokes 101(1) in its proper place. The yoke plate 102(1) is further held down by each of the securing arms 106(1) which are bolted into the rail tie T with bolts 112 entering the securing arms 106(1) through holes 110. The bolt 112 may be lag bolts secured into the tie T or one machine bolt 112 may be used through a hole drilled into the tie T, with the machine bolt 112 encompassing both holes 110 and being secured with a machine nut on the far side securing arm 106(1). After installation, the machine nut may be welded to the machine bolt 112 to prevent loosening or vandalism. The exemplary assembly and operation of the railroad rail and tie fastener apparatus 100 with FIGS. 1-3 is the same with any of the exemplary variations of FIGS. 4-10, except with the added benefits these variations provide as already illustrated and described herein.

Accordingly, as illustrated and described with reference to the examples herein this technology provides more secure and longer lasting railroad rail and tie fastener apparatuses and methods thereof. Additionally, this technology provides a stronger holding force and more accurate and precise retention of the railroad rails to the ties, which is especially important for high-speed rail or heavy load use. With this technology, reduced construction costs and faster railroad construction can be achieve by preassembling entire track sections utilizing this technology and then transporting them to the installation site. Further, with this technology less maintenance is required and greater safety is provided.

Having thus described the basic concept of the invention, it will be rather apparent to those skilled in the art that the foregoing detailed disclosure is intended to be presented by way of example only, and is not limiting. Various alterations, improvements, and modifications will occur and are intended to those skilled in the art, though not expressly stated herein. These alterations, improvements, and modifications are intended to be suggested hereby, and are within the spirit and scope of the invention. Additionally, the recited order of processing elements or sequences, or the use of numbers, letters, or other designations therefore, is not intended to limit the claimed processes to any order except as may be specified in the claims. Accordingly, the invention is limited only by the following claims and equivalents thereto.

What is claimed is:

1. A fastener apparatus for a railroad rail and tie, the apparatus comprising:

a yoke plate comprising a first plate extending along a first plane and a second plate extending out from an edge of the first plate and along a second plane which is at a different angle from the first plane;

at least one securing tooth extending out from the second plate in a first direction; and opposing securing arms spaced apart from each other a distance to detachably seat over the railroad tie and extending out from the first plate in the first direction.

2. The apparatus as set forth in claim 1 further comprising a first plate tab extending out from a different edge of the first plate.

3. The apparatus as set forth in claim 2 wherein the first plate tab extends out substantially along the first plane and further comprises a rail plate securing device configured to detachably secure the first plate tab to a rail plate.

4. The apparatus as set forth in claim 2 wherein at least a portion of the first plate tab extends out substantially along a third plane which is substantially parallel to the first plane and further comprising a rail plate securing device configured to detachably secure the portion of the first plate tab that extends out substantially along the third plane to the rail plate.

5. The apparatus as set forth in claim 2 wherein the first plate tab comprises:

a first portion of the first plate tab that detachably seats on a surface of the first plate;

a second portion of the first plate tab that extends out substantially along a third plane which is substantially parallel to the first plane;

a third portion of the first plate tab that extends out substantially along a fourth plane which is substantially parallel to the first plane and third plane;

a first plate securing device is configured to detachably secure the first portion to the surface of the first plate;

a rail plate securing device is configured to detachably secure the second portion to a rail plate; and a railroad tie securing device configured to detachably secure the third portion to the railroad tie.

6. The apparatus as set forth in claim 1 wherein the at least one securing tooth comprises two or more securing teeth.

7. The apparatus as set forth in claim 1 wherein an opposing end of the at least one securing tooth is tapered.

8. The apparatus as set forth in claim 1 wherein the at least one securing tooth has a substantially cylindrical shape.

9. The apparatus as set forth in claim 1 further comprising at least one guide rail extending along a surface of at least one of the opposing securing arms, the at least one guide rail having a shape configured to detachably mate with a corresponding slot in the railroad tie.

10. The apparatus as set forth in claim 1 further comprising railroad tie securing devices configured to detachably secure each of the opposing securing arms to the railroad tie.

11. The apparatus as set forth in claim 1 further comprising an arm tab extending out from a side of at least one of the securing arms.

12. The apparatus as set forth in claim 1 further comprising a rail plate with at least one aperture, the at least one aperture having an outer periphery shaped to detachably mate with the at least one securing tooth.

13. The apparatus as set forth in claim 1 further comprising:

another yoke plate comprising another first plate extending along a third plane and another second plate extending out from an edge of the another first plate and along a fourth plane which is at a different angle from the third plane;

at least one other securing tooth extending out from the another second plate in the first direction;

other opposing securing arms spaced apart from each other a distance to detachably seat over the railroad tie and extending out from the another first plate in the first direction; and a stabilizing safety bar secured adjacent one end to one of the opposing securing arms and adjacent another end to one of the other securing arms.

14. The apparatus as set forth in claim 13 further comprising a rail plate with an aperture for the at least one securing tooth and another aperture for the at least one other securing tooth, the aperture having an outer periphery shaped to detachably mate with the at least one securing tooth and the another aperture having an another outer periphery shaped to detachably mate with the at least one other securing tooth.

15. A method for making a fastener apparatus for a railroad rail and tie, the method comprising:

providing a yoke plate comprising a first plate that extends along a first plane and a second plate that extends out from an edge of the first plate and along a second plane which is at a different angle from the first plane;

providing at least one securing tooth that extends out from the second plate in a first direction; and providing opposing securing arms that are spaced apart from each other a distance to detachably seat over the railroad tie and extend out from the first plate in the first direction.

16. The method as set forth in claim 15 further comprising providing a first plate tab that extends out from a different edge of the first plate.

17. The method as set forth in claim 16 wherein the providing the first plate tab further comprises providing the first plate tab that extends out substantially along the first plane and further comprising providing a rail plate securing device configured to detachably secure the first plate tab to a rail plate.

18. The method as set forth in claim 16 wherein the providing the first plate tab further comprises providing at least a portion of the first plate tab that extends out substantially along a third plane which is substantially parallel to the first plane and further comprising providing a rail plate securing device configured to detachably secure the portion of the first plate tab that extends out substantially along the third plane to the rail plate.

19. The method as set forth in claim 16 wherein the providing the first plate tab further comprises:

providing a first portion of the first plate tab that detachably seats on a surface of the first plate;

providing a second portion of the first plate tab that extends out substantially along a third plane which is substantially parallel to the first plane;

providing a third portion of the first plate tab that extends out substantially along a fourth plane which is substantially parallel to the first plane and third plane;

providing a first plate securing device is configured to detachably secure the first portion to the surface of the first plate;

providing a rail plate securing device is configured to detachably secure the second portion to a rail plate; and providing a railroad tie securing device configured to detachably secure the third portion to the railroad tie.

20. The method as set forth in claim 15 wherein the providing at least one securing tooth further comprises providing at least two or more securing teeth.

21. The method as set forth in claim 15 wherein the providing at least one securing tooth further comprises providing an opposing end of the at least one securing tooth that is tapered.

22. The method as set forth in claim 15 wherein the providing at least one securing tooth further comprises providing the at least one securing tooth having a substantially cylindrical shape.

23. The method as set forth in claim 15 further comprising providing at least one guide rail extending along a surface of at least one of the opposing securing arms, the at least one guide rail having a shape configured to detachably mate with a corresponding slot in the railroad tie.

24. The method as set forth in claim 1 further comprising providing railroad tie securing devices configured to detachably secure each of the opposing securing arms to the railroad tie.

25. The method as set forth in claim 15 further comprising providing an arm tab extending out from a side of at least one of the securing arms.

26. The method as set forth in claim 15 further comprising providing a rail plate with at least one aperture, the at least one aperture having an outer periphery shaped to detachably mate with the at least one securing tooth.

27. The method as set forth in claim 15 further comprising:

providing another yoke plate comprising another first plate that extends along a third plane and another second plate that extends out from an edge of the another first plate and along a fourth plane which is at a different angle from the third plane;

providing at least one other securing tooth that extends out from the another second plate in the first direction;

providing other opposing securing arms that are spaced apart from each other a distance to detachably seat over the railroad tie and extending out from the another first plate in the first direction; and securing a stabilizing safety bar adjacent one end to one of the opposing securing arms and adjacent another end to one of the other securing arms.

28. The method as set forth in claim 27 further comprising providing a rail plate with an aperture for the at least one securing tooth and another aperture for the at least one other securing tooth, the aperture having an outer periphery shaped to detachably mate with the at least one securing tooth and the another aperture having an another outer periphery shaped to detachably mate with the at least one other securing tooth.

* * * * *